US006757928B2

(12) United States Patent
Lee

(10) Patent No.: US 6,757,928 B2
(45) Date of Patent: Jul. 6, 2004

(54) DECK GAP CLEANING TOOL

(76) Inventor: Jack Raymond Lee, 7216 Grubby Thicket Way, Bethesda, MD (US) 20817

( * ) Notice: Subject to any disclaimer, the term of this patent is extended or adjusted under 35 U.S.C. 154(b) by 0 days.

(21) Appl. No.: 10/151,857

(22) Filed: May 22, 2002

(65) Prior Publication Data

US 2002/0189037 A1 Dec. 19, 2002

Related U.S. Application Data

(60) Provisional application No. 60/292,915, filed on May 24, 2001.

(51) Int. Cl.[7] ..... A47L 13/00

(52) U.S. Cl. ..... 15/104.001; 15/144.1; 15/236.01; 15/236.06; 15/236.09

(58) Field of Search ..... 15/104.001, 142, 15/144.1, 235.4, 235.8, 236.01, 236.05, 236.06, 236.08, 236.09

(56) References Cited

U.S. PATENT DOCUMENTS

| | | | | | |
|---|---|---|---|---|---|
| 509,875 | A | * | 12/1893 | Campbell | 15/236.01 |
| 988,457 | A | * | 4/1911 | Glasscock | 15/235.8 |
| 1,223,064 | A | * | 4/1917 | Meader | 15/236.06 X |
| 2,089,245 | A | * | 8/1937 | Barron | 15/236.01 X |
| 2,236,093 | A | * | 3/1941 | Friend | 15/236.06 X |
| 4,229,032 | A | * | 10/1980 | Murphy | 15/236.06 X |
| 4,358,123 | A | | 11/1982 | Richards | 280/47.131 |
| 4,817,229 | A | * | 4/1989 | Sedillo | 15/236.01 X |
| 5,054,278 | A | | 10/1991 | Thorndike | 56/400.14 |
| 5,058,275 | A | | 10/1991 | Staubli | 30/170 |
| 5,471,696 | A | | 12/1995 | Linfoot | 15/104.001 |
| 5,666,683 | A | | 9/1997 | Gairdner | 15/104.001 |
| 5,740,577 | A | | 4/1998 | Wade | 15/104.001 |
| 5,813,083 | A | | 9/1998 | Gould | 15/236.01 |
| 5,850,657 | A | | 12/1998 | List et al. | 15/105 |
| 6,205,608 | B1 | | 3/2001 | Bowen | 15/104.001 |
| 6,526,619 | B1 | * | 3/2003 | Cassels, Jr. | 15/144.1 X |

* cited by examiner

*Primary Examiner*—Mark Spisich
(74) *Attorney, Agent, or Firm*—Liniak, Berenato & White, LLC

(57) ABSTRACT

A deck gap cleaning tool comprises a pole and a cleaning head. The cleaning head comprises an upper portion that is pivotally connected to the pole, and a blade extending opposite to the pole. The blade is configured to be received between deck flooring gaps for clearing debris therefrom.

34 Claims, 7 Drawing Sheets

DECK GAP CLEANING TOOL

CROSS REFERENCE TO RELATED APPLICATIONS

This is a nonprovisional application of provisional application, serial No. 60/292,915, filed May 24, 2001, by Jack R. Lee, entitled Deck Gap Cleaning Tool, the disclosure of which is herein incorporated by reference, and priority of which is claimed.

BACKGROUND OF THE INVENTION

1. Field of the Invention

The disclosed invention relates to a deck cleaning tool having a specially designed cleaning head that is pivotally connected to a handle. The invention allows for easy clearing of dirt and debris from the gap located between decking floor boards in outdoor exposed decking.

2. Description of the Prior Art

Decking floor boards in outdoor decking or flooring are exposed to extreme weather conditions, as well as debris from trees, plants, and animals. Such decking or flooring may include the floor surface of outdoor decks, porches, gazebos, patios, walkways, or other such areas as are known in the art. The decking or flooring is constructed as spaced planking or boards, with gaps between the planks or boards. Such flooring may be manufactured from either wood or synthetic material, such as plastic, vinyl, or fiberglass.

It is important that the deck board gaps allow for proper water drainage. In addition, these gaps allow for expansion and contraction of the material due to variations in climatic conditions. If the gaps are allowed to clog with debris, improper water drainage may result. Water saturated decking may increase or accelerate deck board decay, cause insect infestation, and cause mold and fungus growth. Furthermore, if the deck is attached to an indoor structure, improper water drainage may result in water runoff into or around the indoor structure, and cause damage. A deck with clogged floor board gaps may also have an aesthetically unappealing appearance.

Various gap cleaning tool designs in the prior art attempt to solve the above noted problems. Some designs simply provide for a blade connected to a handle, which may be pushed along a gap of the decking floor boards. Although this design may loosen some debris in the gaps, the effective angle at which an operator may push the tool is limited. In addition, the orientation of the blade shape relative to the gap being cleaned varies depending on the angle at which the handle is being held, given the blade has a fixed connection to the handle. The blade orientation is therefore dependent on the size of the user, as well as the angle at which the user holds the handle during operation. If the user holds the handle too high or too low, inefficient or unsafe operation may result. The resultant angle of the blade, determined by the user, may not clean the entire depth of the gap, or become impeded by the underlying cross support joists. Furthermore, sharp blades may cut into the flooring boards or support joists, thereby causing damage to the flooring. Such damage to the floor boards or support joists may increase or accelerate the material decay, cause insect infestation, etc., thereby affecting the integrity of the structure. Therefore, such designs do not provide for easy or safe operation.

Other designs provide for a device having a handle with a hook extending from one end. This design generally requires the operator to pull the hooked end along the gaps between the deck floor boards. Again, such a design does not allow for the operator to easily maneuver the tool at variable angles while maintaining optimum clearing power. Such a design generally provides clearing power only when pulled by the user.

Another design in the prior art provides for a blade attached to a handle with a pair of wheels mounted on the blade or handle for contacting the deck surface. Although this design provides some improvement over other designs, the blade is still fixed to the handle at a set angle. Therefore, ease of operation is again limited as noted above.

The disclosed invention solves the above noted problems, providing a deck gap cleaning tool that is effective and easy to use for any operator. The disclosed invention provides optimum gap clearing power regardless of the angle at which the user holds the handle. Furthermore, the gap clearing tool is equally effective when either pushed or pulled by the user. The disclosed tool may also effectively clean flooring gaps in hard to reach areas, such as under railings, furniture, seating areas, and the like.

SUMMARY OF THE INVENTION

A deck gap cleaning tool comprises a pole pivotally connected to a cleaning head. The cleaning head comprises an upper portion pivotally connected to the pole and a blade extending opposite to the pole. The blade is configured to be received between deck flooring gaps for clearing debris therefrom.

The deck gap cleaning head may also comprise sides extending perpendicular to the blade, and intermediate the upper portion and the blade. In one embodiment of the claimed invention, a deck gap cleaning tool comprises a cleaning head support having an elongate body with a top and a bottom surface. The top surface is pivotally connected to a pole at an intermediate point on the elongate body. A plurality of the cleaning heads is pivotally connected to the bottom surface of the cleaning head support. The cleaning heads are positioned on the bottom surface of the support so that multiple gaps may be cleared simultaneously.

DETAILED DESCRIPTION OF THE INVENTION

Figure 1:
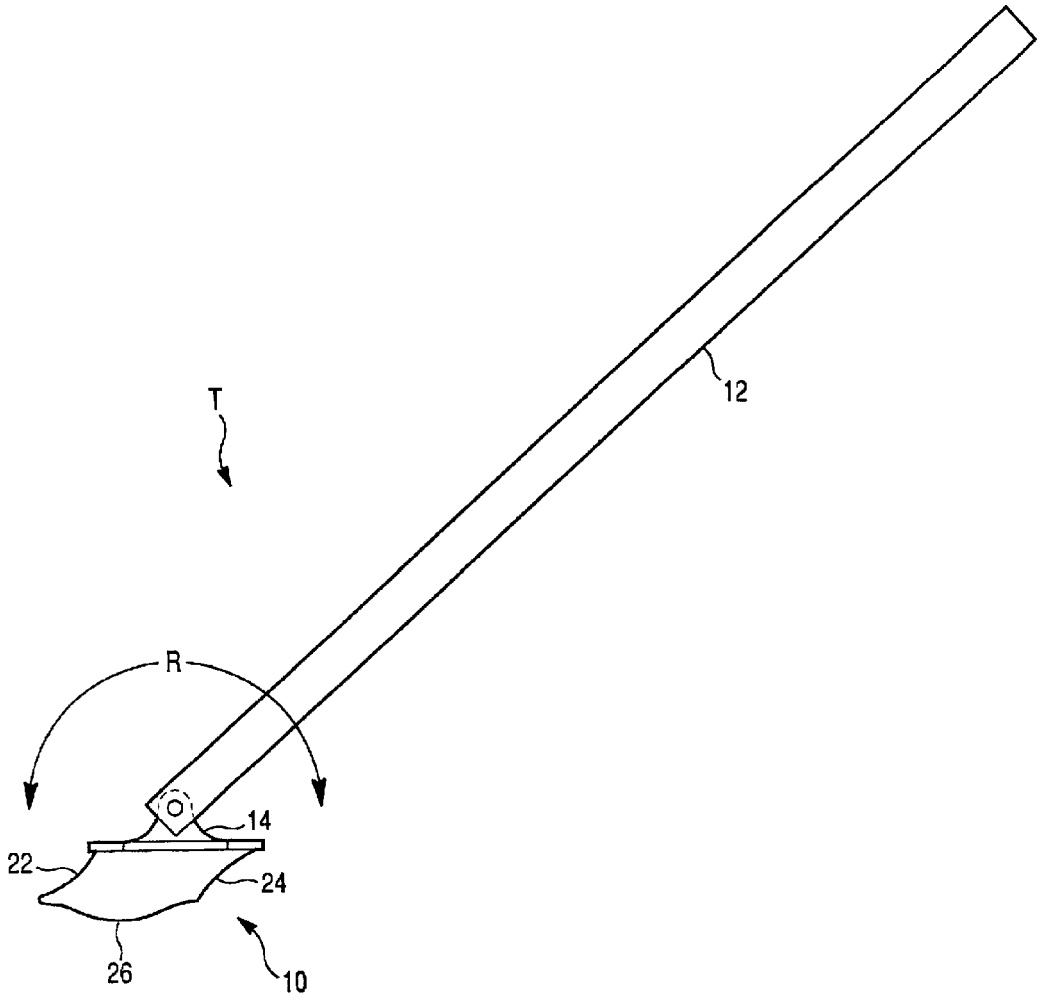
FIG. 1 is an illustration of a deck gap cleaning tool according to the present invention.

As best shown in FIG. 1, a deck gap cleaning tool T comprises a cleaning head 10, which is secured to a handle 12. Handle 12 may be any elongated pole, and is preferably as long as a standard broom handle, as known in the art. Handle 12 is pivotally connected to cleaning head 10, allowing 180 degrees of rotation of handle 12 relative to cleaning head 10, as shown in FIG. 1 by rotational arrows R.

Figure 2:
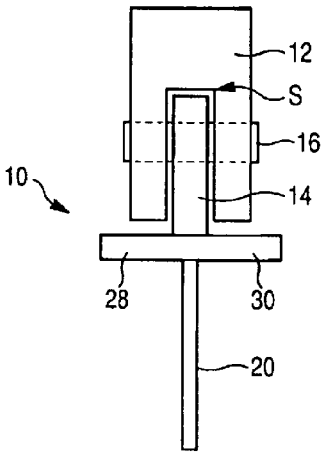
FIG. 2 is a fragmentary front view of a gap cleaning tool according to the present invention.

As best shown in FIG. 2, cleaning head 10 has an upper portion 14, for operable association with a fastener 16, which pivotally connects handle 12 to cleaning head 10. Handle 12 may have a slot S operably associated with upper portion 14 and fastener 16, as best shown in FIG. 2. Upper portion 14 is pivotally secured within slot S by fastener 16. Fastener 16 passes through an associated opening in slot S, and through a corresponding opening in upper portion 14, thereby securing upper portion 14 therein, as shown in FIG. 2.

Figure 3:
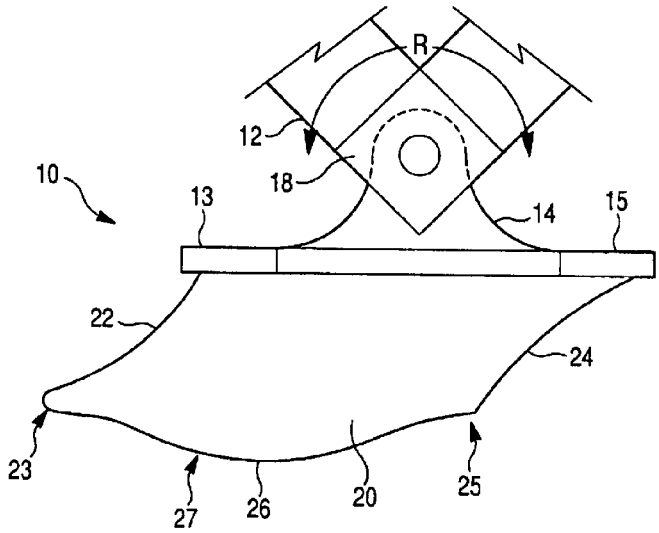
FIG. 3 is a fragmentary side view of a gap cleaning tool according to the present invention.
Figure 9:
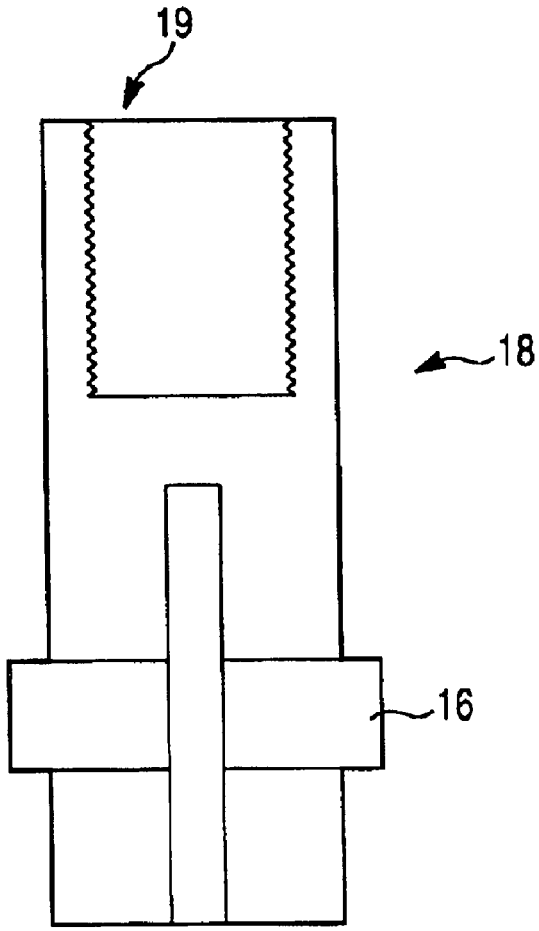
FIG. 9 is a cross-sectional view of a threaded receiver according to the present invention.

A preferred embodiment of the present invention is best shown in FIG. 3, wherein upper portion 14 is pivotally connected to a threaded receiver 18 for receiving and securing a common broom handle 12. Threaded receiver 18, as best shown in FIG. 9, has a threaded end 19 for receiving a standard threaded broom handle. The opposite end of threaded receiver 18 is pivotally secured to upper portion 14 by fastener 16. Thus, handle 12 may be screwed into receiver 18, and still have a pivotal connection allowing for 180 degrees of rotation between handle 12 relative to cleaning head 10 and blade 20, as shown in FIG. 3 by arrow R.

Also shown in FIG. 3, a blade 20 extends from cleaning head 10 opposite upper portion 14, as well as handle 12. Blade 20 is configured to be received between deck flooring gaps G for clearing debris therefrom. Blade 20 has opposing edges 22 and 24, and bottom edge 26, as best shown in FIG. 3. Bottom edge 26 is preferably wave-shaped, so that bottom edge 26 extends from a first crest 23, to an intermediate trough 27, to a second crest 25. Intermediate trough 27 is preferably equidistant from first crest 23 and second crest 25.

As best shown in FIG. 3, first edge 22 extends from a first end 13 of upper portion 14 to first crest 23. First edge 22 is preferably arcuate, and is outwardly disposed from first end 13. The arcuate curve of first edge 22 is plow-shaped, which forces debris up and out of gap G when the user pushes tool T when handle 12 is pivoted away from first edge 22, or pulls tool T when handle 12 is pivoted toward first edge 22. Second edge 24 extends from a second end 15 of upper portion 14 to second crest 25. Second edge 24 is also preferably arcuate, but is inwardly disposed from second end 15, as shown in FIG. 3. The arcuate curve of second edge 24 is also plow-shaped, but forces debris down and through gap G when the user pulls tool T and handle 12 is pivoted toward second edge 24, or pushes tool T and handle 12 is pivoted away from second edge 24.

The plow-shaped design of first and second edges 22 and 24 allows for efficient clearing of debris from gap G. The user may effectively clean debris from gap G by either pushing or pulling tool T, as shown by directional arrows P in FIG. 5, given the mirror design of the two opposing edges 22 and 24.

Figure 5:
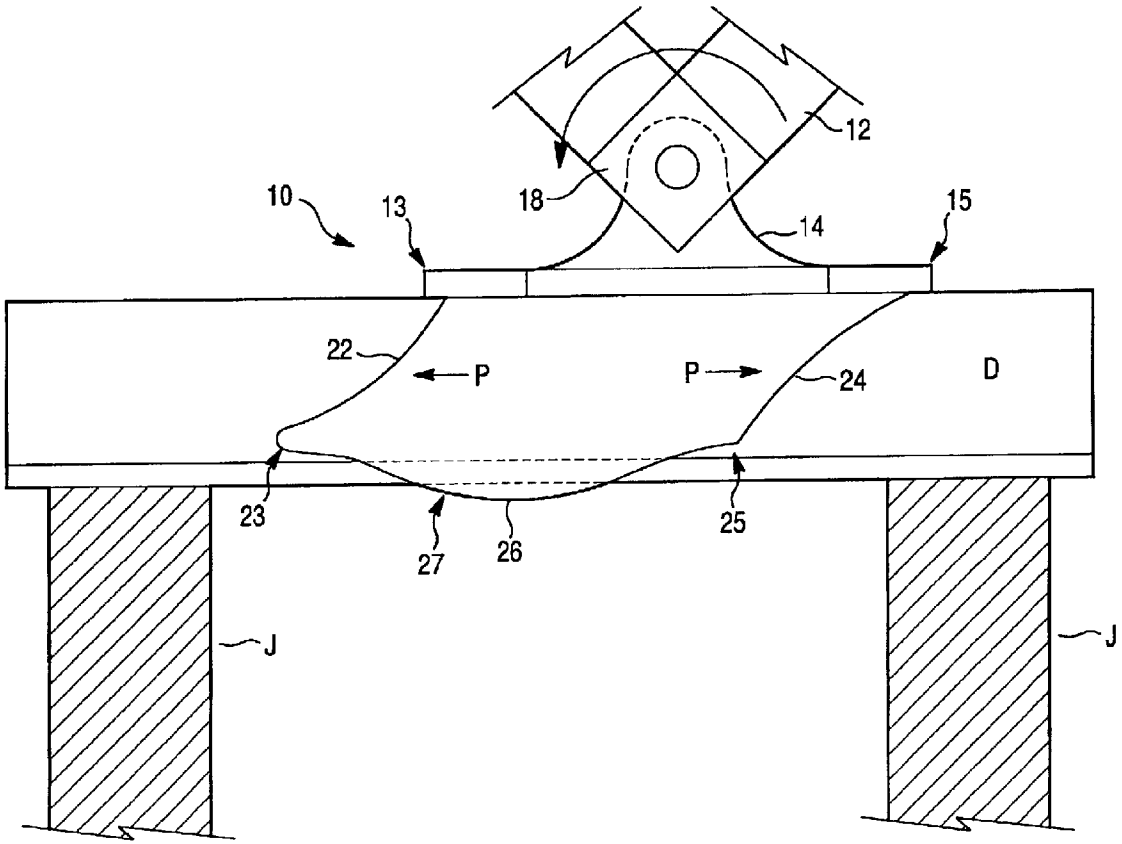
FIG. 5 is a cross-sectional side view of a decking with support joists and a fragmentary side view of a gap cleaning tool according to the present invention.

As best shown in FIG. 5, bottom edge 26 is designed so that edges 22 and 24 ride over underlying deck joists J, while still effectively clearing all debris between gaps G, regardless of the thickness of the deck floor boards. Thus, the need to stop and lift cleaning head 10 over or around underlying joists J during operation is eliminated, and damage to any joists J is prevented. In addition, edges 22 and 24, and bottom edge 26, are preferably blunt, thereby preventing blade 20 from cutting into any joists J or deck boards D.

Figure 4:
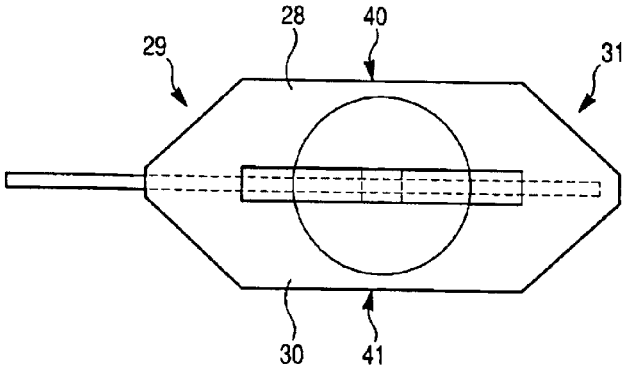
FIG. 4 is a top view of a cleaning head according to the present invention.

As best shown in FIGS. 2 and 4, cleaning head 10 may also have sides 28 and 30 extending perpendicular to blade 20, and intermediate upper portion 14 and blade 20. Sides 28 and 30 form a first conical-shaped end 29 proximate first end 13 of upper portion 14, as well as a second conical-shaped end 31 proximate second end 15 of upper portion 14. As best shown in FIG. 4, second conical end 31 is opposite first conical end 29. First and second conical ends 29 and 31 move the cleared debris away from gap G, and help to eliminate re-clogging of gap G during operation of tool T. The removed debris may then be easily collected and discarded. Sides 28 and 30 have first and second edges 40 and 41, which extend intermediate first and second conical ends, 29 and 31. First and second edges 40 and 41 preferably extend parallel to blade 20.

Figure 6:
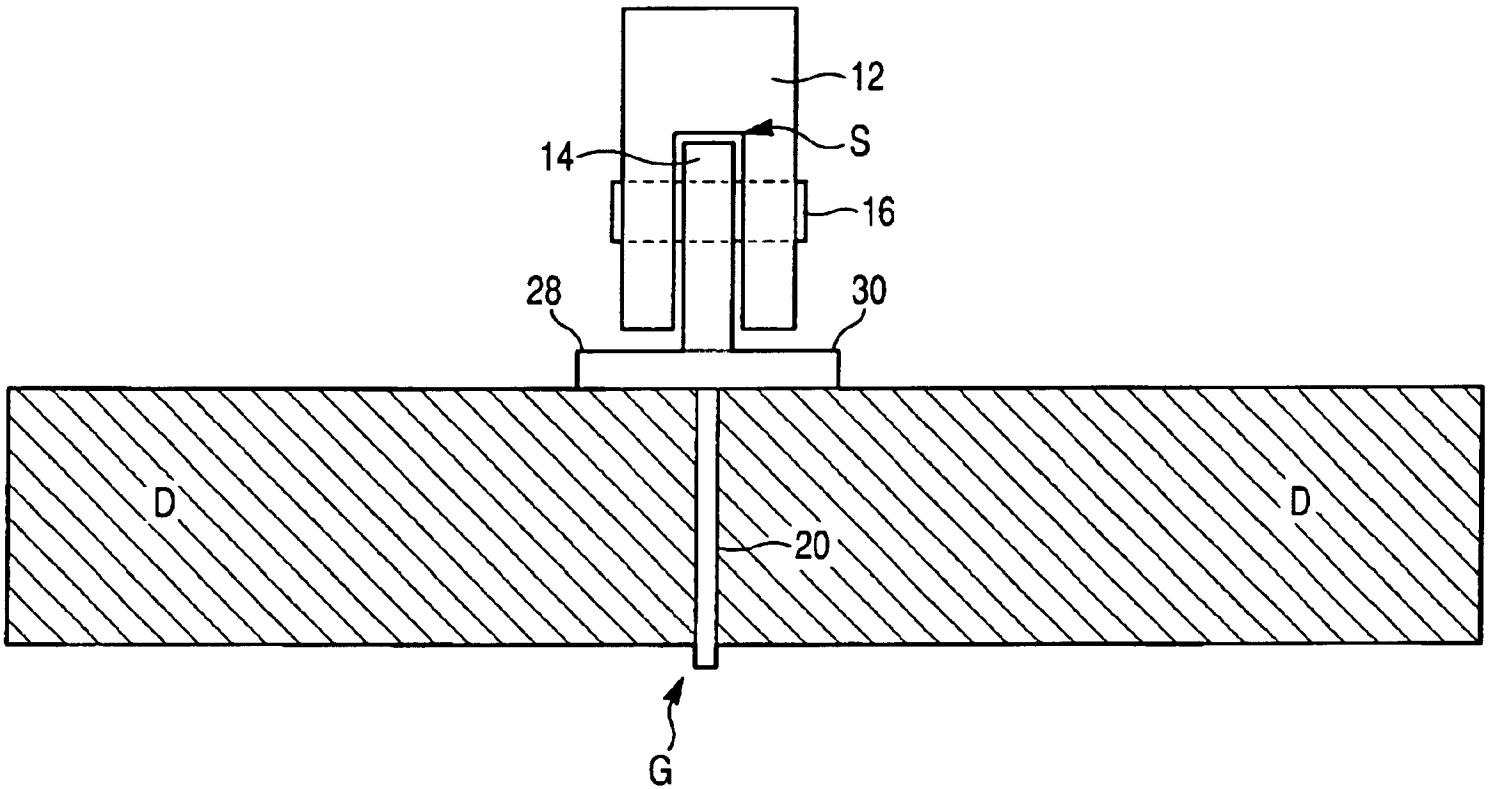
FIG. 6 is a cross-sectional front view of a decking and a fragmentary front view of a gap cleaning tool according to the present invention.

During operation, sides 28 and 30 remain flush with the deck flooring surface, riding over the surface of opposing deck boards D that form gap G being cleared, as best shown in FIG. 6. In this way, sides 28 and 30 help to guide blade 20 through gap G during operation. In addition, sides 28 and 30 help the user maintain balance during operation, given cleaning head 10 and handle 12 are better stabilized by sides 28 and 30.

Figure 7:
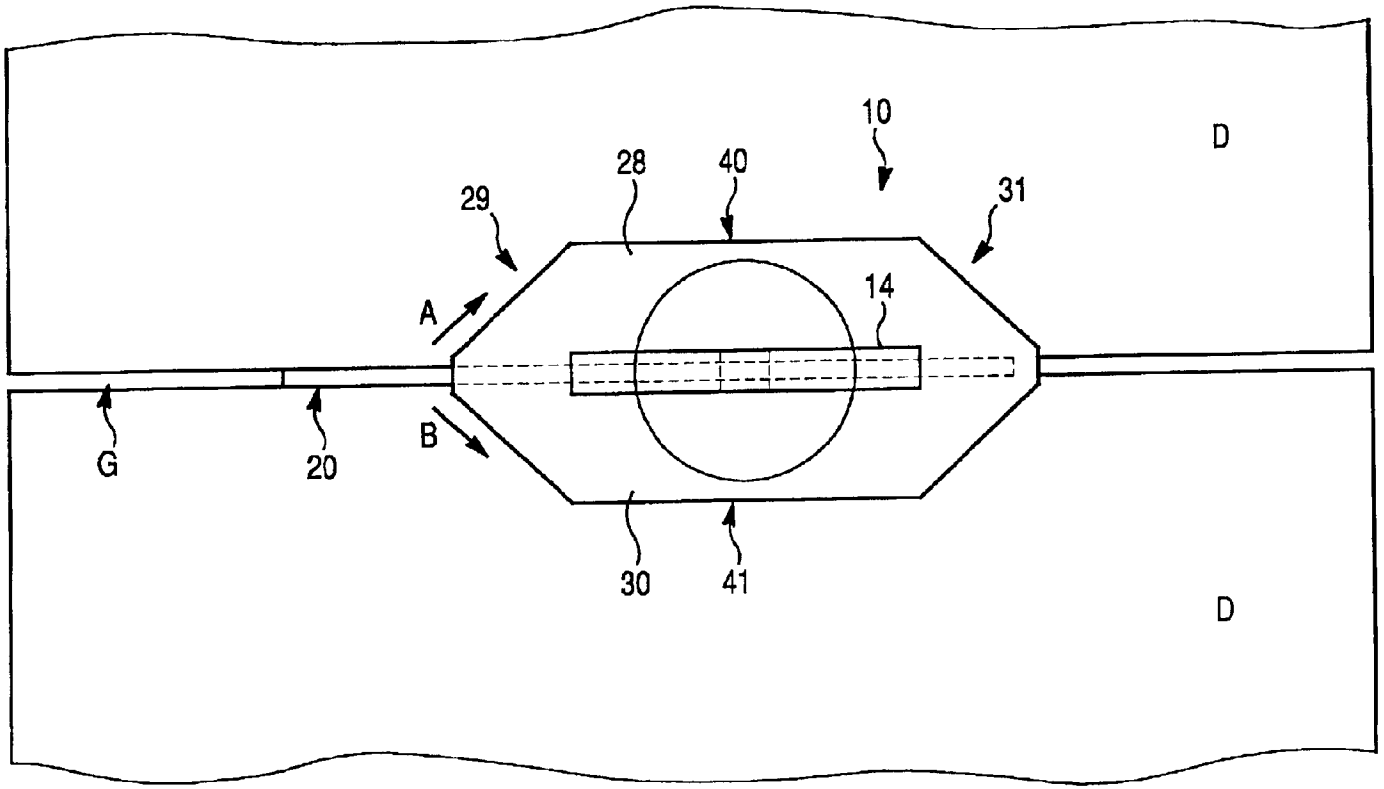
FIG. 7 is a top view of a deck surface and top view of a cleaning head according to the present invention.

As best shown in FIG. 7, cleaning head 10 forces dirt and debris out of the gap being cleared without damage to the decking D, as shown by arrows A and B. Cleaning head 10 remains flush with the flooring surface regardless of a user's preferred angle of operation for handle 12 relative to the flooring surface, given the pivotal connection which allows for 180 degrees of rotation between handle 12 and blade 20. Thus, cleaning head 10 maintains optimum clearing ability regardless of the angle at which the user holds handle 12. Furthermore, blade 20 is designed to work equally well with a wide range of decking board thickness, and is configured to fit into a wide range of gaps G.

Tool T is designed to either push dirt down through the flooring gaps, or lift it up out of the gaps by the blunt, plow-like edges 22 and 24 and bottom edge 26. The design of blade 20 allows for effective clearing power with both a pushing or pulling action. Thus, the disclosed invention provides for efficient and easy operation.

Cleaning head 10 may be comprised of either metal or plastic. A plastic cleaning head 10 is preferably comprised of a stiff plastic, allowing for some flex of the blade during operation so that the blade conforms to gap G without breaking or snapping.

Figure 8:
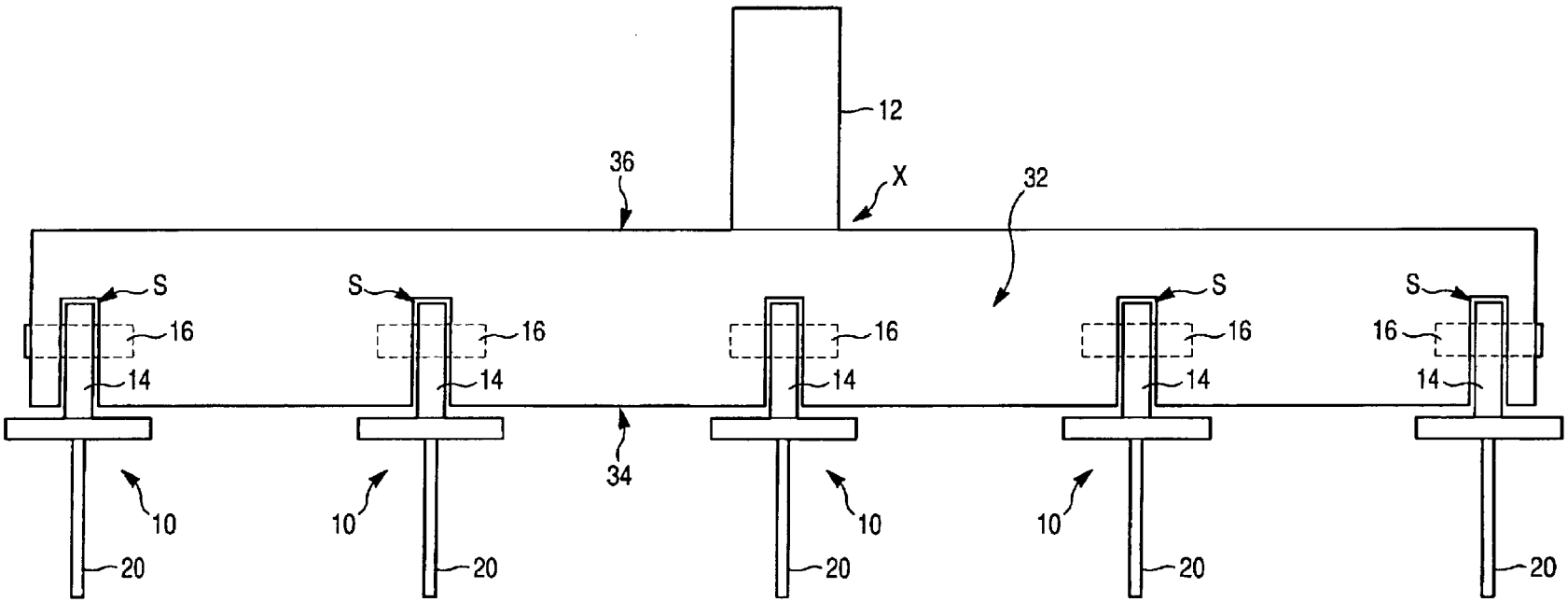
FIG. 8 is a fragmentary front view of a second embodiment of the present invention.

As best shown in FIG. 8, a second embodiment of the claimed invention includes multiple cleaning heads 10, which are each pivotally connected to a cleaning head support 32 in the same manner as explained above. Therefore, each cleaning head 10 is pivotally secured to cleaning head support 32 to allow for 180 degrees of rotation for each blade 20 relative to handle 12. Cleaning head support 32 contains a bottom surface 34 and an upper surface 36. Support 32 contains a plurality of slots S for securing upper portion 14 of each cleaning head 10 using a plurality of fasteners 16. As shown in FIG. 8, five cleaning heads 10 are connected to bottom surface 34. However, any number of cleaning heads 10 may be connected to support 32. Handle 12 may be pivotally connected to upper surface 36 at an intermediate point X on support 32. However, a non-pivotal, fixed attachment of handle 12 to upper surface 36 is preferred, as shown in FIG. 8. A firm attachment of handle 12 at point P, intermediate support 32, increases stability of tool T, thereby increasing clearing power when tool T is pushed or pulled by the user. Blades 20 are positioned on support 32 to be received between adjacent deck flooring gaps. Debris in multiple gaps may therefore be simultaneously cleared during operation.

It will be apparent to one of ordinary skill in the art that various modifications and variations can be made in construction or configuration of the present invention without departing from the scope or spirit of the invention. Thus, it is intended that the present invention cover the modifications and variations of the invention, provided they come within the scope of the following claims and their equivalents.

What is claimed is:

1. A deck gap cleaning tool, comprising:

a pole; and a cleaning head comprising an upper portion pivotally connected to said pole and a blade extending opposite to said pole and configured to be received between deck flooring gaps for clearing debris therefrom, said upper portion pivotally connected to said pole to allow for 180 degrees of rotation between said pole relative to said blade, and said cleaning head including a first side and a second side extending perpendicular to said blade and intermediate said upper portion and said blade, said first and second sides forming a first conical end proximate a first end of said upper portion and a second conical end proximate a second end of said upper portion and opposite said first conical end.

2. The deck gap cleaning tool of claim 1, wherein said first and second sides have first and second edges extending intermediate said first and second conical ends, and extending parallel said blade.

3. The deck gap cleaning tool of claim 1, wherein said blade comprises a first edge, a second edge, and a bottom edge.

4. The deck gap cleaning tool of claim 3, wherein said bottom edge is wave-shaped so that said bottom edge extends from a first crest, to an intermediate trough, to a second crest.

5. The deck gap cleaning tool of claim 4, wherein said trough is equidistant from said first and second crests.

6. The deck gap cleaning tool of claim 5, wherein said first edge extends from a first end of said upper portion to said first crest.

7. The deck gap cleaning tool of claim 6, wherein said first edge is arcuate.

8. The deck gap cleaning tool of claim 7, wherein said first edge is outwardly disposed from said first end of said upper portion.

9. The deck gap cleaning tool of claim 8, wherein said first edge is plow-shaped.

10. The deck gap cleaning tool of claim 5, wherein said second edge extends from a second end of said upper portion to said second crest.

11. The deck gap cleaning tool of claim 10, wherein said second edge is arcuate.

12. The deck gap cleaning tool of claim 11, wherein said second edge is inwardly disposed from said second end of said upper portion.

13. The deck gap cleaning tool of claim 12, wherein said second edge is plow-shaped.

14. The deck gap cleaning tool of claim 1, wherein said upper portion is pivotally connected to a receiver fitted to receive a threaded handle.

15. The deck gap cleaning tool of claim 1, further comprising:

a cleaning head support comprising an elongate body having a top surface and a bottom surface, said top surface connected to said pole at an intermediate point on said elongate body; and a plurality of said cleaning heads pivotally connected to said bottom surface, said cleaning heads positioned on said bottom surface so that multiple deck flooring gaps may be cleared simultaneously.

16. The deck gap cleaning tool of claim 15, wherein said plurality of cleaning heads are pivotally connected to said bottom surface to allow for 180 degrees of rotation between said pole relative to each one of said blades.

17. The deck gap cleaning tool of claim 16, wherein each one of said blades comprise a first edge, a second edge, and a bottom edge.

18. The deck gap cleaning tool of claim 17, wherein said bottom edge is wave-shaped so that said bottom edge extends from a first crest, to an intermediate trough, to a second crest.

19. The deck gap cleaning tool of claim 18, wherein said first edge is outwardly disposed from a first end of said upper portion to said first crest.

20. The deck gap cleaning tool of claim 19, wherein said second edge is inwardly disposed from a second end of said upper portion to said second crest.

21. The deck gap cleaning tool of claim 20, wherein said first and second edges are plow-shaped.

22. A deck gap cleaning head for clearing debris between decking floor boards, comprising:

an upper portion pivotally connected to a receiver configured to receive a threaded handle of a pole;

a blade extending opposite to said upper portion and configured to be received between deck flooring gaps for clearing debris therefrom, said upper portion pivotally connected to said receiver to allow for 180 degrees of rotation between said receiver relative to said blade; and first and second sides extending perpendicular to said blade and intermediate said upper portion and said blade, said sides forming a first conical end proximate a first end of said upper portion, and a second conical end proximate a second end of said upper portion opposite said first conical end.

23. The deck gap cleaning head of claim 22, wherein said first and second sides have first and second edges extending intermediate said first and second conical ends, and extending parallel to said blade.

24. The deck gap cleaning head of claim 22, wherein said blade comprises a first edge, a second edge, and a bottom edge.

25. The deck gap cleaning tool of claim 24, wherein said bottom edge is wave-shaped, so that said bottom edge extends from a first crest, to an intermediate trough, to a second crest.

26. The deck gap cleaning tool of claim 25, wherein said intermediate trough is equidistant from said first and second crests.

27. The deck gap cleaning tool of claim 26, wherein said first edge extends from a first end of said upper portion to said first crest.

28. The deck gap cleaning tool of claim 27, wherein said first edge is arcuate.

29. The deck gap cleaning tool of claim 28, wherein said first edge is outwardly disposed from said first end of said upper portion.

30. The deck gap cleaning tool of claim 29, wherein said first edge is plow-shaped.

31. The deck gap cleaning tool of claim 25, wherein said second edge extends from a second end of said upper portion to said second crest.

32. The deck gap cleaning tool of claim 31, wherein said second edge is arcuate.

33. The deck gap cleaning tool of claim 32, wherein said second edge is inwardly disposed from said second end of said upper portion.

34. The deck gap cleaning tool of claim 33, wherein said second edge is plow-shaped.

* * * * *